United States Patent [19]

Hennes et al.

[11] 4,173,678

[45] Nov. 6, 1979

[54] COLOR BLENDED YARNS WITH ENHANCED LUMINOSITY

[75] Inventors: John H. Hennes, Anderson; Christopher P. Crecente, Mauldin, both of S.C.

[73] Assignee: Badische Corporation, Williamsburg, Va.

[21] Appl. No.: 927,697

[22] Filed: Jul. 24, 1978

[51] Int. Cl.[2] ..... D02G 3/00

[52] U.S. Cl. ..... 428/364; 57/244; 428/373; 428/397

[58] Field of Search ..... 428/364, 373, 374, 357, 428/397; 57/140 R, 140 BY, 243, 244, 248

[56] References Cited

U.S. PATENT DOCUMENTS

| | | | |
|---|---|---|---|
| Re. 29,352 | 8/1977 | Newton | 57/140 BY X |
| 3,460,336 | 8/1969 | Collingwood et al. | 57/140 BY |
| 3,468,121 | 9/1969 | Nakashima et al. | 57/140 BY X |
| 3,479,810 | 11/1969 | Eshurs | 57/140 BY |
| 3,681,910 | 8/1972 | Reese | 428/373 X |
| 3,724,199 | 4/1973 | Armstrong et al. | 57/140 BY X |
| 3,811,263 | 5/1974 | Newton | 57/140 BY X |
| 3,899,562 | 8/1975 | Seidl | 264/210 F |
| 3,950,932 | 4/1976 | Durling | 57/140 R |
| 3,950,933 | 4/1976 | Tufhill | 57/140 R |
| 3,955,254 | 5/1976 | Delarue | 28/255 |
| 4,019,312 | 4/1977 | Warrick | 57/140 BY X |
| 4,059,873 | 11/1977 | Larson | 28/271 |

*Primary Examiner*—Lorraine T. Kendell
*Attorney, Agent, or Firm*—George F. Helfrich

[57] ABSTRACT

Disclosed is a non-twisted, non-commingled, draw-textured, multi-colored yarn having enhanced luminosity and vibrancy of color. The yarn has a total denier of from 1000 to 4000 and is produced from 4 to 16 discrete component yarns of a particular coloration and/or dye receptivity which are longitudinally disposed in a side-by-side registration. Each component yarn has a denier of about 250 and is made up of a multiplicity of continuous filaments of 10 to 20 denier/filament, all of which have the same coloration and/or dye receptivity. There are from 2 to 8 different colorations or dye receptivities present in the yarn. However, there is no discernable predominance of a single coloration or dye receptivity in any longitudinal or transverse segment of the yarn. Moreover, fabrics prepared from this yarn do not possess undesirable patterns, streaks, or blotches of color.

4 Claims, 3 Drawing Figures

COLOR BLENDED YARNS WITH ENHANCED LUMINOSITY

BACKGROUND OF THE INVENTION

1. Field of the Invention

The present invention relates generally to multi-colored continuous filament yarns. In particular the invention relates to a non-twisted, non-commingled, draw-textured yarn produced from a plurality of discrete component yarns of a particular coloration and/or dye receptivity.

2. Prior Art Statement

The use of multi-colored yarns to produce fabrics having a vibrant color has frequently resulted in the formation of undesirable patterns, streaks, or blotches of color. For example, in the fabrication of tufted carpets, the presence of 2,3, or more like-colored tufts occurring in sequence is not only a mathematical likelihood, but also an often observed phenomenon.

As a consequence, a number of expedients have been devised over the years in an attempt to obviate this disadvantage. Of particular pertinence in this regard are the following patents:

1. U.S. Pat. No. 4,059,873 discloses a continuous filament "heather" yarn, which is composed of a plurality of crimped continuous filament yarns of at least 400 denier having different color and/or dye receptivity and being substantially free of twist. Each of the crimped continuous filament yarns comprises a plurality of continuous filaments, which are randomly intermingled from yarn to yarn to form yarn-to-yarn-blended areas of random lengths. These yarn-to-yarn-blended areas hold the crimped continuous filament yarns together to form the heather yarn, and the distribution of these areas among the unblended areas, as well as the lengths and proportions of the unblended areas allows for employment of the heather yarn in the production of a fabric which is substantially free of streaks. However, the fabric so produced is characterized by the colors of the crimped continuous filament yarns being visible but muted in appearance.

In sharp contrast thereto, the component yarns of the multi-colored yarn of the present invention are not commingled, but are instead longitudinally disposed in a side-by-side registration. Moreover, the denier of each component yarn must be less than 400, viz. about 250. When the multi-colored yarn of the present invention is employed in the production of fabrics, streaks, undesirable patterns, and blotches are indeed absent. Moreover, the individual colors are not muted or washed out, but instead come through with enhanced luminosity and vibrancy. This phenomenon and its significance may be better understood when it is compared with the method of "divisionism" in painting, whereby colors are separated into their components, which are then laid side-by-side upon a canvas in order to be recomposed in the eye of the observer to produce an effect of greater vibration and luminosity.

2. U.S. Pat. No. Re 29,352 (U.S. Pat. No. 3,811,263) discloses a non-twisted "heather" yarn formed from a plurality of major yarn bundles, at least one of which is of a substantially different color from the remaining bundles. Each major yarn bundle is formed from a multiplicity of continuous filaments and has from about 10 to about 90 percent of its filaments cohering to form secondary bundles, with the remaining filaments of each major bundle being interlaced with other major bundles of the yarn. Each of the secondary bundles in each unit length of the yarn of about 6 inches has a portion formed from greater than about 30 percent of the filaments of its major bundle. Each of the secondary bundles in every unit length of the yarn of about 8 inches is non-uniformly oriented relative to the yarn axis.

To summarize, this reference discloses an interlaced yarn having dominant colors. In contradistinction thereto, there is no discernable dominance of a single coloration in any longitudinal or transverse segment of the yarn of the present invention. As a result, the yarn of this reference will produce patterns and streaks in a fabric produced therefrom, whereas the yarn of the present invention will not. Furthermore, although the number and size of the component yarns of the reference are not defined, the single example shows a combination of three 833 denier component yarns. This is in no way suggestive of the requirement of from 4 to 16 component yarns of about 250 denier, which is essential in the preparation of a multi-colored yarn according to the present invention.

3. U.S. Pat. No. 3,950,932 discloses a multi-colored, cabled, stuffer box crimped yarn, which contains filaments of at least two non-contrasting colors and a contrasting color. Employed are at least 3 multifilament component yarns of 675 denier which are first twisted and then plied together (e.g., ten such component yarns of 6 different colors are utilized.)

The required twisting unfortunately reduces the bulk of the yarn of this reference and imparts an undesirably harsh hand to fabrics prepared therefrom. As there is no such twisting in the yarn of the present invention, advantages alleged in the reference are in face achieved—without the attending disadvantages.

4. U.S. Pat. No. 3,899,562 discloses homogeneous, mixed multi-colored yarns. That is to say, extruded monofilament thread groups of different colors are alternately disposed and subsequently gathered into a yarn with the monofilaments intermixed to provide a substantially homogeneous cross section.

Sharply contrasting therewith is the yarn of the present invention, wherein the individual colors are present in discrete bands of component yarns. Instead of muting or washing out the colors—as does the homogeneity required in the yarn of the reference—the structure of the yarn of the present invention enhances color clarity and effects a greater vibrancy and luminosity, as "divisionism" does in painting (see discussion under U.S. Pat. No. 4,059,873, supra).

5. U.S. Pat. No. 3,955,254 discloses a method and apparatus for treating yarn with a fluid, which is caused to impinge upon the yarn as it advances through a chamber. By means of a plurality of coordinated and controlled circuits, dyes of different colors may be directed into the chamber through which the yarn advances, resulting in yarn having a wide variety of color patterns.

As a result of mixing of the dyes in the feed apparatus and diffusion of the dyes in the solutions contacting the yarn, sharply defined structures similar to that of the multi-colored yarn of the present invention are not possible according to the process and apparatus of this reference. Accordingly, enhanced luminosity and vibrancy of color do not result.

Clearly none of the references of the prior art provides or even remotely suggests the structure of the yarn of the present invention, or the heretofore unobtainable combination of properties thereof and benefits resulting from the utilization thereof.

SUMMARY OF THE PRESENT INVENTION

Obviating the disadvantages of the prior art products is the multi-colored yarn of the present invention, which is a non-twisted, non-commingled, draw-textured yarn having a total denier of from 1000 to 4000. This yarn is made up from 4 to 16 discrete component yarns of a particular coloration or dye receptivity longitudinally disposed in a side-by-side registration (i.e., in the nature of "bands"), each component having a denier of about 250. Each component yarn is itself made up of a multiplicity of continuous filaments of 10 to 20 denier/filament, all of which have the same coloration or dye receptivity. There are from 2 to 8 different colorations or dye receptivities present in the multi-colored yarn.

Especially advantageous results are obtained when the component yarns are comprised of filaments of either nylon or polyester. Indeed, one or more component yarns may be made up of nylon filaments while the remaining component yarn(s) may be made up of polyester filaments.

BRIEF DESCRIPTION OF THE DRAWING

For a more complete understanding of the present invention, including its outstanding benefits, reference should be made to the Detailed Description of the Preferred Embodiments, which is set forth below. This detailed description should be read together with the accompanying drawing, wherein.

DETAILED DESCRIPTION OF THE PREFERRED EMBODIMENTS

Figure 1:
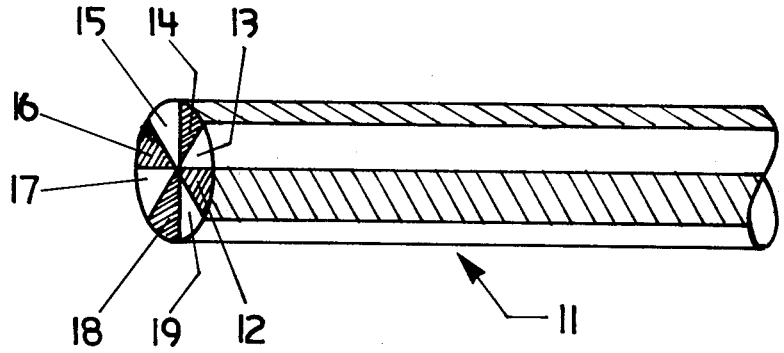
FIG. 1 is a perspective view schematically representing a multi-colored yarn according to the present invention.

Referring now to the drawing, there is schematically shown in FIG. 1 an embodiment (11) of a non-twisted, non-commingled, draw-textured, multi-colored yarn according to the present invention, draw-texturing having been accomplished by any of a number of standard methods well known in the art. In the embodiment (11) as shown, there are 8 discrete component yarns (12), (13), (14), (15), (16), (17), (18), and (19), which are longitudinally disposed in a side-by-side registration. Each of these component yarns comprises a multiplicity of continuous filaments of about 10 to 20 denier/filament, all of which filaments in a given component yarn having the same coloration or dye receptivity. The denier of each component yarn is about 250. In the embodiment (11) as shown, there are 8 discrete component yarns; however, there may be as many as 16 or as few as 4 such component yarns, each of which have a denier of about 250, thereby providing a multi-colored yarn according to the present invention having a total denier from about 1000 to about 4000. In the embodiment (11) as shown, component yarns (13), (15), (17), and (19), have the same coloration or dye receptivity, and component yarns (12), (14), (16), and (18) have the same coloration or dye receptivity, which coloration or dye receptivity is different from that of component yarns (13), (15), (17), and (19). Accordingly, there are 2 different colorations or dye receptivities present in embodiment (11) of the multi-colored yarn of the present invention as shown. However, the present invention comprehends as many as 8 different colorations or dye receptivities in the multi-colored yarn. That is to say, in the embodiment (11) as shown, each of the component yarns (12), (13), (14), (15), (16), (17), (18), and (19) may have a coloration or dye receptivity different from that of the other component yarns. Moreover, as the present invention comprehends from 2 to 8 different colorations or dye receptivities in the multi-colored yarn, some of the component yarns may have a coloration or dye receptivity which is the same as that of one, two, three, or more of the other component yarns. In any event, the component yarns are positioned so that there is no discernable predominance of any single coloration or dye receptivity in any longitudinal or transverse segment of the yarn.

Component yarns (12), (13), (14), (15), (16), (17), (18), and (19) are advantageously comprised of nylon continuous filaments or polyester continuous filaments of any cross-sectional configuration. Moreover, at least one component yarn may be comprised of nylon while at least one component yarn is comprised of polyester. Yarn (11) is characterized as non-twisted and non-commingled; that is to say, there is generally no more than about 0.5 twists per inch and no more than about 5 percent of intermixing of component yarns along the longitudinal axis of the multi-colored yarn (11). If the denier of the individual continuous filaments is less than about 10, the multi-colored yarn (11) is too soft; if the denier of the individual continuous filaments is greater than about 20, the multi-colored yarn (11) is too wiry.

Figure 2:
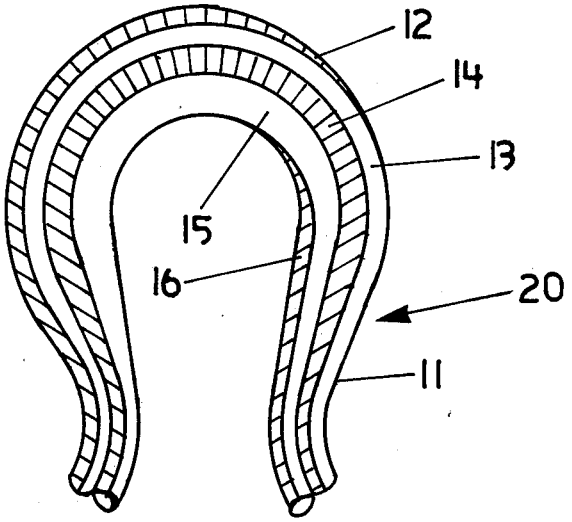
FIG. 2 is a side elevation schematically representing a carpet tuft that might be formed from the yarn of FIG. 1.
Figure 3:
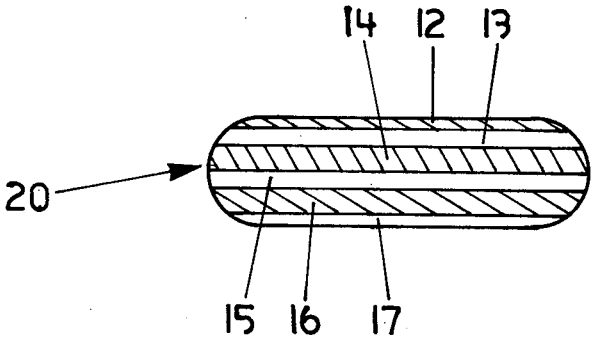
FIG. 3 is a top view schematically representing the same carpet tuft shown in side elevation in FIG. 2.

In FIG. 2, which is a side elevation schematically representing a standard carpet tuft (20) that might be formed from the yarn (11) of FIG. 1, it is seen that the characteristic side-by-side registration of component yarns in yarn (11) (e.g., (12), (13), (14), (15), and (16), as shown) is maintained in standard carpet tufting processes. The significance of this is seen in FIG. 3, which is a top view schematically representing the same carpet tuft (20) shown in side elevation in FIG. 2. Because of the maintenance of this characteristic side-by-side registration of component yarns (e.g., (12), (13), (14), (15), (16), and (17), as shown in FIG. 3), and because the denier of each component yarn is about 250 (i.e., each component yarn is small enough so that the area of the top of standard carpet tufts will contain a plurality of such component yarns), each carpet tuft will display a plurality of colorations on its surface, thereby preventing the occurrence of 2,3, or more like-colored tufts occurring in sequence. (There is no blotching or streaking.) Moreover, such component yarns, which are laid side-by-side on the top surface of the carpet tuft, are recomposed in the eye of the observer to produce an effect of striking vibrancy and a high degree of luminosity.

The following examples will serve to further explicate the yarn of the present invention and illustrate methods for preparation and utilization thereof.

EXAMPLE 1

Nylon 6 polymer chips were melt spun into 726 denier, 14 filament undrawn feed yarn packages. The individual filaments had a round cross-section. Both white and black pigmented yarns were spun individually. Eight of these packages, four white and four black, were arranged in a creel with the white and black in alternating positions. The creel consisted of two vertical posts, each holding four packages. The position of each color in the creel is very critical. Exchanging a white for a black package would change the appearance of the final yarn and any carpet tufted from it.

The eight ends from the creel were led through an eye guide and draw textured in a conventional manner. The draw ratio was 3.5X. The parallelism of the individual ends was maintained through drawing and air jet texturing. This was demonstrated easily by tensioning the yarn to remove the crimp, whereby the colors were clearly seen to run in parallel rows along the axis of the yarn.

The resulting yarn was 2000 denier and 112 filaments. The yarn had a uniform gray appearance. When it was tufted into a level loop carpet it gave the impression of a single color, but unlike a painted floor, it had a vibrancy and depth of color which emphasized the appearance of a third dimension.

If desired to simplify handling in subsequent processing and prevent static blooming, the yarn could be very lightly interlaced at intervals of at least 2 inches or given no more than about 0.5 twists per inch without changing its appearance in the carpet.

EXAMPLE 2

The method of Example 1 was used with the following creel arrangement:

| | |
|---|---|
| Orange | Brown |
| Yellow | Red |
| Black | Orange |
| Orange | Brown |

The resulting carpet had a rich, luminous appearance without patterns or streaks. The color was described as "Autumn Leaf."

EXAMPLE 3

The method of Example 1 was used with the following creel arrangement:

| | |
|---|---|
| Orange | White |
| White | White |
| White | White |
| White | Brown |

This clean, crisp beige shade was described as "Sawdust."

EXAMPLE 4

The method of Example 1 was employed wherein two of the white feed yarn packages were made from filaments with a trilobal cross section. The increase in surface area of the white component provided a carpet having a lighter shade of gray than that of example 1, along with some sparkle (as light is reflected from the relatively flat sections of the filament surface).

EXAMPLE 5

The method of Example 1 was utilized wherein two of the white feed yarn packages were spun from polyethylene terephthalate. In the final carpet the relatively poor matting resistance of the polyester was overcome by the support of the other six nylon component yarns, while use was made of its superior resistance to staining and resistance to actinic degradation.

EXAMPLE 6

The method of Example 1 was followed with the creel expanded to four posts with sixteen feed positions. Using the same alternating arrangement of white and black, a 4000 denier, 224 filament yarn was obtained which yielded a carpet with the same vibrant gray shade as in example 1.

As is understood by those of skill in the art, many combinations of colors, cross sections and polymer types might be used to give an almost limitless range of shades.

EXAMPLE 7

The method of Example 1 was followed, wherein a carbon-impregnated monofilament was also used to provide protection from static discharges.

EXAMPLE 8

The method of Example 1 was employed, wherein yarns with different dye receptivities were used in place of some or all of the pigmented yarns. The following creel arrangement was used to demonstrate this application:

| | |
|---|---|
| Regular dyeable nylon 6 | Cationic dyeable nylon 6 |
| Deep dyeable nylon 6 | Regular dyeable nylon 6 |
| Regular dyeable nylon 6 | Black pigmented |
| Cationic dyeable nylon 6 | Deep dyeable nylon 6 |

The resultant 2000/112 (denier/filaments) yarn was tufted into a level loop carpet and piece dyed using 0.5% Basacryl Red X-GRL and 0.5% Stylacyl Yellow RG. The dyed carpet had the same vibrant hue as those made from the precolored yarns.

If desired, the basic multi-colored yarns according to the present invention may be two-plied, three-plied, or 4-plied (e.g., employing a Verdol direct cable twister) without changing their appearance.

Although the present invention has been pictured, described, and exemplified in particular detail, it is understood by those of skill in this art that variations and modifications in this detail may be effected without any departure from the spirit and scope of the present invention, as defined in the hereto-appended claims.

What is claimed is:

1. A non-twisted, non-commingled, draw-textured, multicolored yarn, which yarn has a total denier of from 1000 to 4000 and comprises from 4 to 16 discrete component yarns of a particular coloration or dye receptivity longitudinally disposed in a side-by-side registration, each component yarn having a denier of about 250 and comprising a multiplicity of continuous filaments of about 10 to 20 denier/filament all of which have the same coloration or dye receptivity, there being from 2 to 8 different colorations or dye receptivities present in the multi-colored yarn, the component yarns being positioned so that there is no discernable predominance of a single coloration or dye recptivity in any longitudinal or transverse segment of the yarn.

2. The yarn of claim 1, wherein the component yarns are comprised of nylon.

3. The yarn of claim 1, wherein the component yarns are comprised of polyester.

4. The yarn of claim 1, wherein at least one component yarn is comprised of nylon and at least one component yarn is comprised of polyester.

* * * * *